US006003287A

United States Patent [19]

Ballestrazzi et al.

[11] Patent Number: 6,003,287

[45] Date of Patent: Dec. 21, 1999

[54] PLANT FOR PACKAGING CANS OR OTHER DISPOSABLE DRINK CONTAINERS, BY MEANS OF HEAT-SHRINKABLE FILM

[75] Inventors: Aris Ballestrazzi; Lamberto Tassi, both of Savignano Sul Panaro, Italy

[73] Assignee: Sitma S.p.A., Modena, Italy

[21] Appl. No.: 09/041,310

[22] Filed: Mar. 12, 1998

[30] Foreign Application Priority Data

Mar. 13, 1997 [IT] Italy ..... MI97A0560

[51] Int. Cl.[6] ..... B65B 9/06; B65B 53/02

[52] U.S. Cl. ..... 53/546; 53/550; 53/557; 53/202

[58] Field of Search ..... 53/557, 202, 546, 53/550

[56] References Cited

U.S. PATENT DOCUMENTS

| | | | |
|---|---|---|---|
| 2,555,758 | 6/1951 | Noble et al. | 53/550 |
| 2,918,769 | 12/1959 | Anderson et al. | 53/546 |
| 3,581,457 | 6/1971 | Gerlach | 53/202 X |
| 4,054,474 | 10/1977 | Collins et al. | 53/557 X |
| 4,338,768 | 7/1982 | Ballestrazzi et al. | 53/557 X |
| 4,537,016 | 8/1985 | Shanklin et al. | 53/550 X |
| 5,050,368 | 9/1991 | Noh . | |
| 5,155,979 | 10/1992 | McDonald | 53/202 |
| 5,765,336 | 6/1998 | Neagle et al. | 53/202 X |

FOREIGN PATENT DOCUMENTS

| | | |
|---|---|---|
| 1 437 430 | 3/1966 | France . |
| 2 344 453 | 10/1977 | France . |
| FI/95/U/89 | 9/1995 | Italy . |

*Primary Examiner*—Linda Johnson
*Attorney, Agent, or Firm*—Oblon, Spivak, McClelland, Maier & Neustadt, P.C.

[57] ABSTRACT

The plant for packaging cans or other disposable drink containers by use of a heat-shrinkable film which includes a support frame; at least two feed lines for cans, with respective buffer zones, and including sensors for sensing passage of an individual can; a device feeding the cans recumbent and aligned into the at least two lines; a device feeding at least one heat-shrinkable film web associated with a device for wrapping the film web over the cans of each line; a welding and cutting unit with a longitudinal welder on each line and at least one welder oriented transverse to both of the lines; a heat-shrinking tunnel common to the various lines; and a package expulsion zone.

7 Claims, 1 Drawing Sheet

PLANT FOR PACKAGING CANS OR OTHER DISPOSABLE DRINK CONTAINERS, BY MEANS OF HEAT-SHRINKABLE FILM

BACKGROUND OF THE INVENTION

1. Field of the Invention

This invention relates to a plant for packaging cans or other disposable drink containers, by means of heat-shrinkable film.

2. Discussion of the Background

It has already been proposed to package cans or other disposable drink containers by means of heat-shrinkable film, for example in Italian utility model application FI95U 000089 of 15.9.199, but without succeeding in defining a plant suitable for this packaging because of a series of constructional problems.

In this respect, to form such packages the plant must offer a high production rate while being of relatively small overall size. Moreover, because of the purpose for which it is intended, the plant must be of low installation and operating cost, because otherwise this additional packaging of the can or similar container would increase its purchase price to an unacceptable extent.

SUMMARY OF THE INVENTION

Consideration must also be given to the fact that the term "cans or other disposable drink containers" includes not only the traditional metal can but also any other container of glass, plastic, impermeabilized food-quality cardboard, etc. In the present description and in the embodiment shown on the drawings, in all cases reference is made in particular to cans for simplicity.

These and further objects are attained by a plant comprising substantially:

- a support frame;
- at least two feed lines, with respective side-by-side or superposed buffer zones and with sensors for sensing passage of the cans;
- means for feeding the cans recumbent and aligned into the at least two lines;
- means for feeding at least one heat-shrinkable film web associated with means for wrapping said film web over the cans of each line;
- a welding unit with a longitudinal welder on each line and at least one welder and cutter positioned transverse to both said lines;
- a heat-shrinking tunnel common to the various lines; and
- a package expulsion zone.

Two or more lines can be arranged side by side, or superposed, or some side by side and others superposed.

Advantageously, said film feed means can comprise, for side-by-side lines, a unit for feeding a film web having a width which is a multiple of that required for each line; and an element for the intermediate longitudinal cutting-to-size of said web for an individual package.

A pitching device can also be provided, for operating on side-by side lines to transversely align the cans of the various lines and maintain them longitudinally spaced apart by a predetermined extent during their successive advancement. In this manner for example a single welder can be used for transverse cutting and welding, for several side-by-side lines.

Other characteristics will be apparent from the accompanying claims.

BRIEF DESCRIPTION OF THE DRAWINGS

The invention will be more apparent from the ensuing description and the accompanying drawings, which show a non-limiting embodiment of the invention. In the drawings.

DESCRIPTION OF THE PREFERRED EMBODIMENTS

Figure 1:
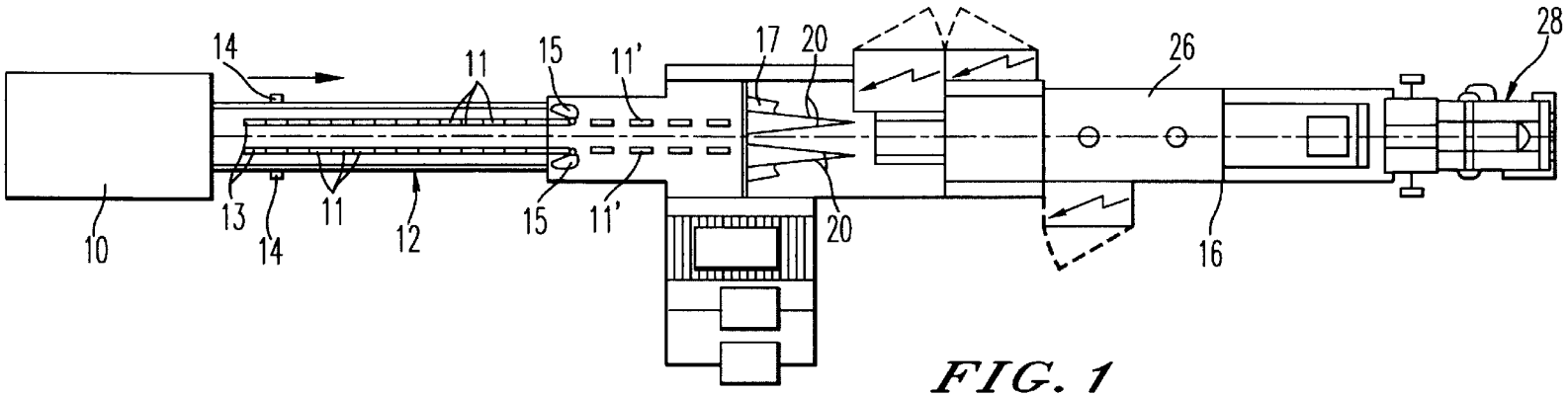
FIG. 1 is a very summary schematic plan view of the arrangement of a plant according to the present invention comprising two side-by-side lines.

As shown in FIG. 1, the reference numeral 10 indicates a feed unit for cans 11, which feeds the cans to be packaged to a buffer zone, indicated overall by 12. In the buffer zone 12 a double feed line is formed from the various cans, which are distributed for example on a set of friction rollers (not shown) in two channels 13.

Suitable sensors 14 are provided in the form of sighting devices, for the most part of photoelectric cell type, which monitor the increasing and decreasing quantity so as to be able to control the operation of the feed unit 10 which feeds cans to the buffer zone 12. The buffer zone 12 is supervised by an operator who checks the regularity of the subdivision and of the feed to the subsequent units, with the cans 11 correctly aligned longitudinally.

Reference numeral 15 indicates a pitching device, arranged to operate on each of the side-by-side lines to transversely align the cans 11 of the various lines, and maintain them longitudinally spaced apart by a predetermined extent during their successive advancement. This spacing between successive cans, and the transverse alignment of the pairs of side-by-side cans 11, is particularly advantageous in the film covering and heat-shrinking plant.

Figure 2:
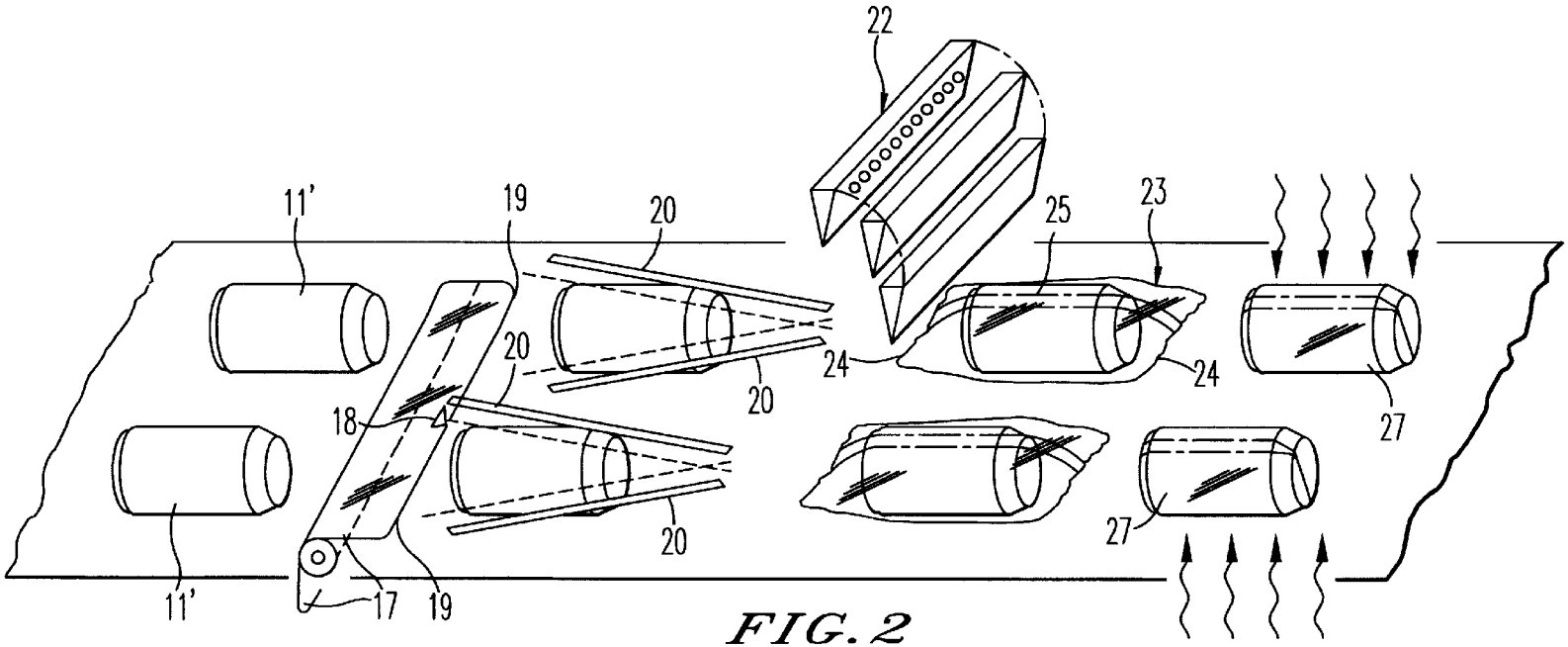
FIG. 2 is a perspective view showing some of the operations performed in the plant of the invention.

The pitching device 15 is followed by a packaging unit, indicated overall by 16, which is formed to implement the packaging on the two lines of spaced-apart cans transversely aligned in pairs, as shown at 11' in FIG. 2. A heat-shrinkable film web 17 originating from a reel (not shown) contained in the underlying part of the plant frame can be fed into the packaging unit 16. In particular, as there is only one web 17 in the illustrated embodiment, it is divided by a cutting element 18 (see FIG. 2) into two webs 19, each of sufficient width to wrap the can 11' arriving from the respective line above the web 17 or above the webs 19. In this case the feeder feeds a film web 17 having a width which is a multiple of that necessary for a web 19 required for each line, the cutter element 18 for longitudinal cutting being positioned on the center line of the web 17. In all cases the longitudinal cutter element 18 is positioned intermediate to the web at distances such as to form individual webs 19 suitable for forming a single package. In a modified embodiment, independently fed single webs 19 can be provided arranged on respective reels, with enough reels provided to effect automatic change without having to halt the entire plant.

The packaging unit also comprises guide means, shown schematically at 20, which deviate the individual webs 19 of the film web 17 from a flat position to a position in which their longitudinal edges are raised for their wrapping about an individual can 11'.

In this manner, the two webs 19 longitudinally wrap the cylindrical wall of the respective cans 11' as they progressively advance, and the free longitudinal edges become superposed one on the other on the individual can 11'.

Downstream of the guide means 20 which perform this wrapping, there is provided a welding and cutting unit, indicated overall by 21, comprising both longitudinal welding means, for example using ionizing welders, and transverse welding means 22. Advantageously, for side-by-side processing lines, a single welding and cutting means 22 can be provided, which simultaneously transversely welds and cuts the webs 19 which have been wrapped about a can 11 on reaching the packaging unit on each of the lines, along which the cans advance spaced apart.

In this manner, downstream of the entire welding and cutting unit 21 a covering 23 of heat-shrinkable film 19 is obtained about each can 11. As shown in FIG. 2, the covering 23 comprises front and rear end transverse welds 24, and a longitudinal weld 25 formed along superposed longitudinal edges of the individual web 19. Following the packaging unit 20 there is a heat-shrinking tunnel 26, into which the cans of the two lines arrive, so that the covering 23 of each can is made to adhere by the effect of the heat-shrinkage achieved in said tunnel 26. The heat-shrinkage derives from the heat which in the direction of the arrows strikes the covering 23 still positioned loosely about the can 11 and causes the film to shrink adherent onto the can, as shown at 27.

This operation is followed by a discharge conveyor 29 for the packaged cans and an expulsion device for rejected packages, which is indicated overall by 28 and is of known type, but has been developed to operate on the two side-by-side lines which reach the expulsion zone, for removing the rejects.

The packaging rate achievable for cans 11 of traditional type of about 33 $cm^3$ of contents can be of the order of 400 cans per minute, representing an appreciable production rate. Notwithstanding this considerable processing rate for cans or similar containers, the overall dimensions of the plant are of the order of about twelve linear meters longitudinally and little more than that of a traditional single-line plant transversely.

Said two or more lines can also be superposed, or the two or more side-by-side lines can be arranged below one or more lines positioned at a higher level.

At the plant exit, cans are obtained packaged in a substantially sterile manner in terms of their subsequent use by the final consumer. In this respect, this latter receives a can which has been completely packaged and sealed in the factory, and hence in a non-contaminated environment, so ensuring perfect hygiene on consumption of the product contained in the can. It is also hygienic to drink the liquid directly from the can by resting the lips on the upper end of the can when opened in the traditional manner by tabs which separate along incision lines typical of such container cans.

The cans of each line can be made to advance with the axis of their curved wall in the direction of advancement, or perpendicular to this direction. The lines can be superposed, or be in two series of side-by-side lines, the two series being superposed one on the other.

The drawing shows only one non-limiting example of the invention, which can be modified in terms of forms and arrangements without leaving the scope of the concept on which the present invention is based. The purpose of possible reference numerals in the ensuing claims is merely to facilitate the reading of the claims with reference to the description and the drawings, and does not limit the scope of protection represented by the claims.

We claim:

1. A plant for packaging cans or other disposable drink containers by means of heat-shrinkable film, which comprises:

a support frame;

at least two feed lines for cans, said feed lines having respective buffer zones, and sensors for sensing passage of an individual can;

a mechanism for feeding the cans in a recumbent position and aligned into said at least two lines;

a mechanism for feeding a single heat-shrinkable film web and cutting said web into separate, substantially flat webs to be positioned respectively onto each of said cans;

a mechanism located downstream of said feeding mechanism for wrapping said film web over each of the cans of each of said at least two lines, said wrapping mechanism including a guide which deviates said webs from a substantially flat position to a position in which longitudinal edges of said webs are raised for being wrapped about said cans by said guide wherein said guide comprises at least one pair of converging guide members which converge in a direction of movement of the cans;

a welding and cutting unit located downstream of said wrapping mechanism, said welding and cutting unit having a longitudinal welder on each line and at least one welder oriented transversely of each of said at least two lines;

a heat-shrinking tunnel common to said lines; and a package expulsion zone.

2. A plant as claimed in claim 1, wherein said at least two lines are located side by side.

3. A plant as claimed in claims 1 or 2, wherein said at least two lines are positioned in proximity with one another.

4. A plant as claimed in claim 1, which comprises at least two side-by-side lines.

5. A plant as claimed in claim 2 or 4, wherein said mechanism for feeding said at least one heat-shrinkable film web comprises, for side-by-side lines, a feeder for a film web having a width which is a multiple of that necessary for a web required for each line, and an element for intermediate longitudinal cutting-to-size of said web for an individual package.

6. A plant as claimed in claim 1, which comprises a pitching device arranged to operate on the various lines for transversely aligning cans advancing along the various lines and for longitudinally spacing them from the adjacent cans of the same line, and a single transverse cutting and welding unit for the side-by-side lines.

7. A plant as claimed in claim 1, which comprises a discharge conveyor for the packaged cans which is located within said expulsion zone and a device for expelling rejected packages.

* * * * *